US006163121A

United States Patent [19]

Kumar et al.

[11] Patent Number: 6,163,121

[45] Date of Patent: Dec. 19, 2000

[54] TORQUE MAXIMIZATION AND VIBRATION CONTROL FOR AC LOCOMOTIVES

[75] Inventors: Ajith K. Kumar; Edgar T. Balch, both of Erie, Pa.

[73] Assignee: General Electric Company, Schenectady, N.Y.

[21] Appl. No.: 09/405,633

[22] Filed: Sep. 24, 1999

Related U.S. Application Data

[60] Provisional application No. 60/117,928, Jan. 29, 1999.

[51] Int. Cl.[7] ..... H02P 7/00

[52] U.S. Cl. ..... 318/434; 318/432; 318/52; 180/197

[58] Field of Search ..... 318/434, 432, 318/52; 180/197

[56] References Cited

U.S. PATENT DOCUMENTS

| | | | |
|---|---|---|---|
| 4,243,927 | 1/1981 | D'Atre | 318/803 |
| 4,896,090 | 1/1990 | Balch et al. | 318/52 |
| 5,841,254 | 11/1998 | Balch et al. | 318/430 |

*Primary Examiner*—Robert E. Nappi
*Assistant Examiner*—Rita Leykin
*Attorney, Agent, or Firm*—Schnader Harrison Segal & Lewis

[57] ABSTRACT

A method and traction control system for an AC locomotive which separately controls the allowable creep level of each individual axle and optimizes traction performance by minimizing torsional vibration per axle. The traction control system includes a torque maximizer and a torsional vibration detector. The torque maximizer evaluates the change in traction system performance levels and actual creep level of individual axles and determines the desired torque maximizer state for maximizing traction performance of each individual axle. The torque maximizer utilizes digital filtering to minimize control cycle time. The torsional vibration detector digitally processes estimated torque feedback of each traction motor in order to detect an unacceptable level of torsional vibration. The outputs of the torque maximizer and the torsional vibration detector are provided to a creep modulator which processes these inputs in order to control the operating creep level of each locomotive axle. As a result, traction performance is improved while minimizing torsional vibration and operating noise levels due to wheel/rail squeal.

16 Claims, 4 Drawing Sheets

TORQUE MAXIMIZATION AND VIBRATION CONTROL FOR AC LOCOMOTIVES

This application claims the benefit under Title 35 U.S.C. §120 of U.S. Provisional Application No. 60/117,928 filed on Jan. 29, 1999.

BACKGROUND OF THE INVENTION

This invention relates to traction control systems for AC locomotives and, more particularly to a torque maximizer, and a method and a system which maximizes torque and minimizes torsional vibration on a per axle basis.

In a modern conventional diesel-electric locomotive, a thermal prime mover (typically a turbo charged diesel engine) is used to drive an electrical transmission comprising a synchronous generator that supplies electric current to a plurality of electric traction motors whose rotors are coupled through speed-reducing gearing to the respective axle-wheel sets of the locomotive. The generator typically comprises a main 3-phase traction alternator, the rotor of which is mechanically coupled to the output shaft of the engine. When excitation current is supplied to field windings on the rotating rotor, alternating voltages are generated in the 3-phase armature windings on the stator of the alternator. These voltages are rectified and applied via a DC link to one or more inverters where the DC voltage is inverted to AC and applied to AC traction motors.

In normal motoring operation, the propulsion system of a diesel-electric locomotive is so controlled as to establish a balanced steady-state condition wherein the engine-driven alternator produces, for each discrete position of a throttle handle, a substantially constant, optimum amount of electrical power for the traction motors. In practice, suitable means are provided for overriding normal operation of the propulsion controls and reducing engine load in response to certain abnormal conditions, such as loss of wheel adhesion or a load exceeding the power capability of the engine at whatever engine speed the throttle is commanding or a fault condition such as a ground fault in the electrical propulsion system.

As is generally known, the 3-phase synchronous alternator in a locomotive propulsion system develops an output voltage which is a function of its rotor shaft RPM and the DC voltage and current applied to its field windings. The 3-phase output is converted to DC power by a 3-phase full-wave bridge rectifier connected to the alternator output windings.

The DC power is coupled to a DC link and supplied to a plurality of parallel connected inverters. Each inverter comprises a plurality of electronically controllable switching devices, such as gate turn-off thyristors (GTO's), which can be gated in and out of conduction in a conventional manner so as to generate an AC output for powering AC electric traction motors coupled in driving relationship to respective axle-wheel sets of the locomotive.

One factor affecting traction performance is the creep level of the locomotive's traction control subsystem. Accordingly, it is desirable to separately control the allowable creep level of each individual axle to maximize traction performance. Additionally, it is desirable to maximize the control system response whose function is to increase or decrease the allowable creep level.

Another factor affecting traction performance is the level of torsional resonant vibration in the mechanical drive train, which is comprise of a locomotive axle and its associated two wheels, the motor to axle gearbox, the induction motor, and the induction motor drive. In particular, during operation in certain regions of the adhesion characteristic curve, the mechanical drive train may experience a net negative damping which produces severe vibration levels at the system's natural frequencies. As is well-known, an adhesion characteristic curve graphically represents the coefficient of friction versus percentage creep. At zero percent creep, maximum damping on the mechanical system is represented. As the percent creep level increases in the portion of the characteristic curve to the left of its peak, the damping effect on the mechanical system decreases to a value of zero at the peak. For increasing percent creep values to the right of the peak, the damping provided to the mechanical system becomes a larger negative number.

The natural frequencies of a system are a function of the drive train component materials and geometries which vary slightly over the life of a locomotive due to wear and tear. Dependent upon the magnitude and duration of the vibration periods, the drive train may be damaged. Accordingly, it is desirable to minimize torsional resonant vibration in order to maximize traction performance.

U.S. Pat. No. 5,841,254 discloses a control system in which creep level and torsional vibration level are utilized to maximize traction performance. This control system is useful for a wide variety of applications and overcomes problems known to those skilled in the art.

SUMMARY OF THE INVENTION

One embodiment of the invention is a traction control system for an AC locomotive which separately controls the allowable creep level of each individual axle and optimizes traction performance by minimizing torsional vibration per axle. The traction control system comprises a torque maximizer and a torsional vibration detector. The torque maximizer evaluates the change in traction system performance levels and actual creep level of individual axles and determines the desired torque maximizer state for maximizing traction performance of each individual axle. Digital filtering is utilized to provide the evaluation of torque and creep changes received by the torque maximizer. Response of the torque maximizer is improved by reducing the time between updates of the filtered variables. The torsional vibration detector digitally processes estimated torque feedback of each traction motor in order to detect an unacceptable level of torsional vibration. The outputs of the torque maximizer and the torsional vibration detector are provided to a creep modulator which processes these inputs in order to control the operating creep level of each locomotive axle. As a result, traction performance is improved while minimizing torsional vibration and operating noise levels due to wheel/rail squeal.

Another embodiment of the invention includes a method for traction control in an electric traction motor propulsion system which includes measuring the performance level of the system and determining a torque maximizer state for maximizing traction performance from measurements of actual creep derivatives and torque derivatives. The torsional vibration level is detected by processing estimated torque feedback. The torque maximizer state and the torsional vibration level are then processed to control the operating creep level.

A further embodiment of the invention includes a torque maximizer comprising a torque feedback filter for filtering a torque feedback signal and a creep limit evaluator capable of receiving a filtered torque feedback signal for determining maximum, minimum and stand-off creep levels. The torque maximizer further includes two torque filters and two creep filters. Torque signals are passed through the first torque filter. The derivative of two consecutive torque signals, obtained from a torque value derivative evaluator, is filtered by the second torque filter. In a like manner, the two creep level filters and a creep level derivative evaluator process actual creep levels. The torque maximizer also includes a torque maximizer state evaluator which processes the filtered torque and creep derivatives to determine a torque maximizer state.

These and other features of the invention will become better understood with reference to the following description.

DETAILED DESCRIPTION OF THE INVENTION

Figure 1:
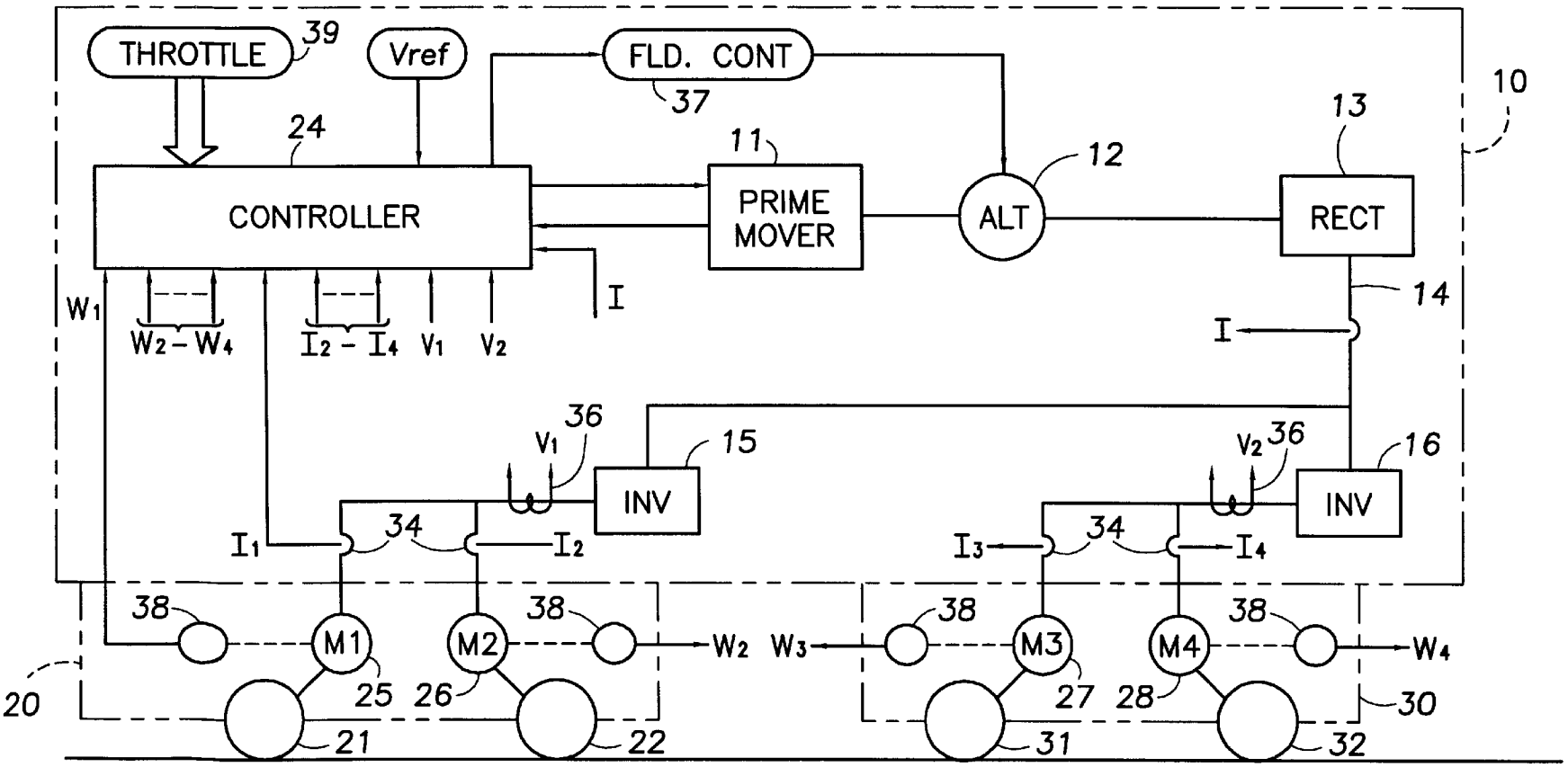
FIG. 1 is a simplified block diagram of the principal components of a propulsion system for a diesel-electric locomotive with which the invention may be used.

This invention may be utilized in various types of alternating current (AC) induction motor powered vehicles such as, for example, off-highway vehicles (earth moving machines), transit cars, and locomotives. For purposes of illustration, the invention is described herein as it may be applied to a locomotive. A traction motor propulsion system 10 of FIG. 1 includes a variable speed prime mover 11 mechanically coupled to a rotor of a dynamo electric machine 12 comprising a 3-phase alternating current (AC) synchronous alternator generator. The 3-phase voltage developed by alternator 12 is applied to AC input terminals of a conventional power rectifier bridge 13. The direct current (DC) output of bridge 13 is coupled via a DC link 14 to a number of controlled inverters 15 and 16 which invert the DC power to AC power at a selectable variable frequency. The inverters 15 and 16 are conventional inverters employing gate turn-off devices (GTO's) which switch in and out of conduction in response to gating signals from a system controller 24 so as to invert the DC voltage on DC link 14 to controlled frequency AC voltage. The AC power is electrically coupled in energizing relationship to each of a plurality of adjustable speed AC traction motors 25–28. Prime mover 11, alternator 12, rectifier bridge 13, and inverters 15 and 16 are mounted on a platform of the traction vehicle 10, illustrated as a 4-axle diesel-electric locomotive. The platform is in turn supported on two trucks 20 and 30, the first truck 20 having two axle-wheel sets 21 and 22 and the second truck 30 having two axle-wheel sets 31 and 32.

Each of the traction motors 25–28 is hung on a separate axle and its rotor is mechanically coupled, via conventional gearing, in driving relationship to the associated axle-wheel set. In the illustrative embodiment, the two motors 25 and 26 are electrically coupled in parallel with one another and receive power from inverter 15 while motors 27 and 28 are coupled to inverter 16.

However, in some instances, it may be desirable to provide an inverter for each motor or to couple additional motors to a single inverter. The invention is not limited to such 4-axle systems and is equally applicable to 6-axle locomotives with six inverters each connected for powering a respective one of six traction motors each connected to respective ones of the six axles.

Suitable current transducers 34 and voltage transducers 36 are used to provide a family of current and voltage feedback signals which are respectively representative of the magnitudes of current and voltage in the motor stators. Speed sensors 38 are used to provide speed signals representative of the rotational speeds W1–W4 in revolutions per minute (RPM) of the motor shafts. These speed signals are converted to wheel speed.

For simplicity, only single lines have been indicated for power flow although it will be apparent that motors 25–28 are typically three phase motors so that each power line represents three lines in such applications.

The magnitude of output voltage and current supplied to rectifier bridge 13 is determined by the magnitude of excitation current supplied to the field windings of alternator 12 by a field controller 37 which may be a conventional phase controlled rectifier circuit since the alternator field requires DC excitation. In response to an operator demand (such as from a throttle 39, for example) for vehicle speed, the excitation current is set by controller 24 which is in turn responsive to actual speed as represented by signals W1–W4. Controller 24 converts the throttle command to a corresponding torque request for use in controlling motors 25–28. Since AC motor torque is proportional to rotor current and air gap flux, these quantities may be monitored; or, more commonly, other quantities, such as applied voltage, stator current and motor RPM, may be used to reconstruct motor torque in controller 24. See, for example, U.S. Pat. No. 4,243,927.

In an electrical braking or retarding mode of operation, inertia of the moving vehicle is converted into electrical energy by utilizing the traction motors as generators. Motor voltage and current are controlled to set a desired braking effort.

Figure 2:
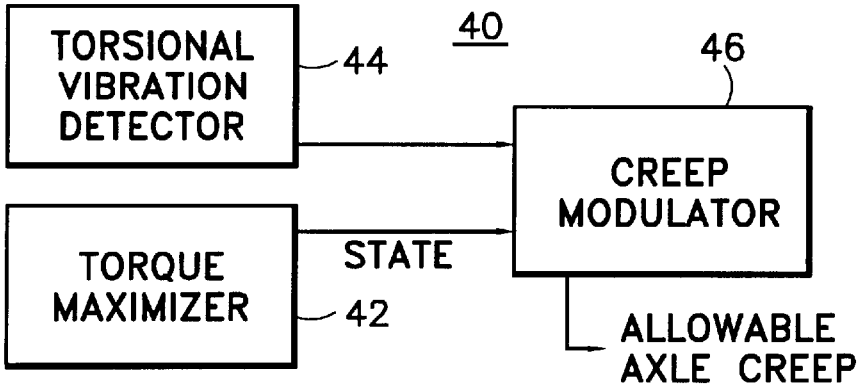
FIG. 2 is a simplified block diagram of a traction control system of the invention.

In the apparatus of FIG. 2, the present invention is embodied in a traction control system 40. Traction control system 40 comprises a torque maximizer 42, a torsional vibration detector 44, and a creep modulator 46. Torque maximizer 42 measures traction system performance levels and determines the desired torque maximizer state for maximizing traction performance of each individual axle. Torsional vibration detector 44 digitally processes estimated torque feedback of each traction motor in order to detect an unacceptable level of torsional vibration.

The outputs of the torque maximizer and the torsional vibration detector are provided to creep modulator 46 which processes these inputs in order to control the operating creep level of each locomotive axle.

Figure 3:
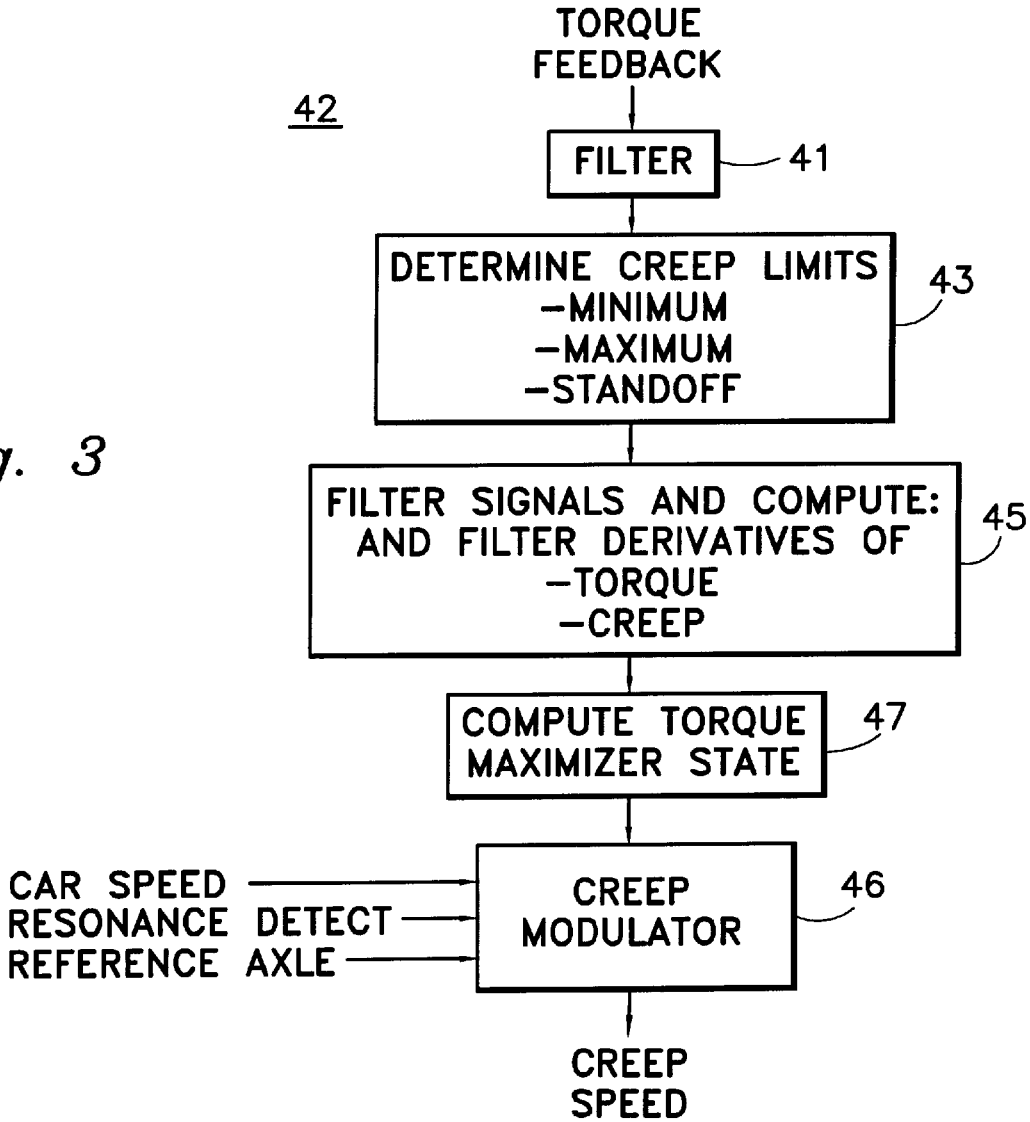
FIG. 3 is a block diagram illustrating one embodiment of a torque maximizer useful in the system of FIG. 2.

FIG. 3 illustrates an embodiment of torque maximizer 42. The function of the torque maximizer is to set the value of the torque maximizer state which, in turn, is used to control operation of the creep modulator. The possible torque maximizer states are as follows: (1) decrease the allowable creep level; (2) increase the allowable creep level; (3) maintain the present allowable creep level; and (4) modulate the allowable creep level toward a stand-off creep limit. The stand-off creep level is the allowable creep level that the adhesion control system will utilize after the system has not been in wheelslip or wheelslide control for a specified time period.

As illustrated in FIG. 3, the torque feedback is an input to the torque maximizer through a torque feedback filter 41. The output of filter 41 is used to determine the creep levels in a creep limit evaluator block 43. The stand-off creep limit is greater than the minimum allowable creep level and less than the maximum allowable creep level. The stand-off creep limit is determined as follows:

stand_off_-creep=min. creep+$k$(max. creep−min. creep), where $k$=fixed constant (0 to 1).

Figure 4:
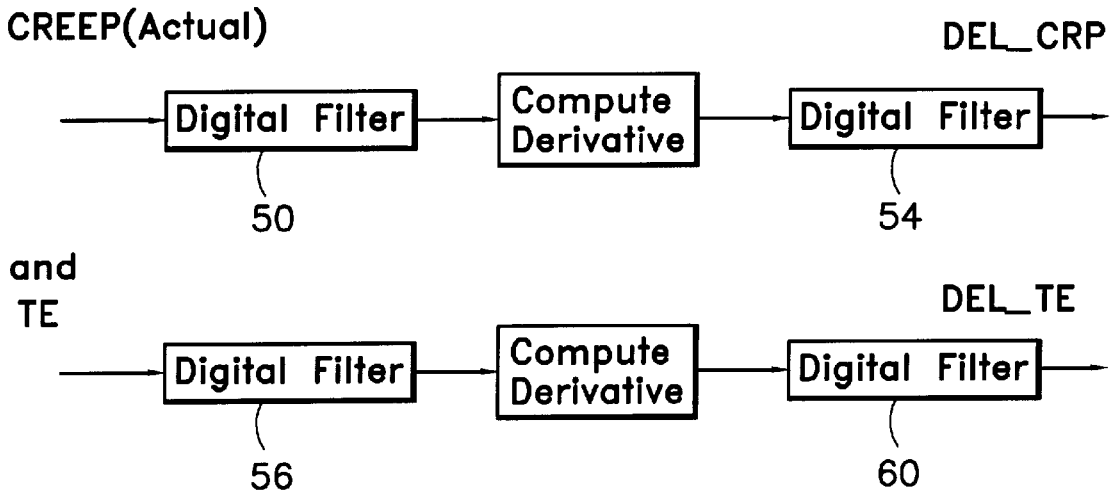
FIG. 4 is a block diagram illustrating the signal flows of the actual creep level and the torque level utilized within the torque maximizer.

Each of the states, or operating modes, is maintained at least for the duration of a sampling period. During the sampling period, the torque level value is obtained in block 45. From the torque values obtained between consecutive sampling periods, the change in the torque value, DEL_TE is evaluated. In a similar manner, with knowledge of the torque maximizer state value during the last sampling period, the change in actual creep level of the axles DEL_CRP is obtained. In block 45 the actual creep level signals and the torque level signals flow through filters as illustrated for example in FIG. 4. The filters include a first torque filter 56 through which a torque signal passes and a second torque filter 60 through which a derivative of consecutive filtered torque signals pass. The filters further include a first creep filter 50 through which an actual creep signal passes and a second creep filter 54 through which a derivative of consecutive filtered actual creep signals pass. Filters 50, 54, 56, 60 are preferably digital filters. Filters 50, 54, 56, 60 allow for a reduction of the sampling period duration. Filters 50, 54, 56, 60 are preferably low-pass filters that are well known in the art. Filters 50, 54, 56, 60 are more preferably filters attenuating higher frequency components of the signals. By reducing the sampling period duration, control cycle time can be reduced. This reduces the amount of time the torque maximizer 42 migrates past a desired level, improving the performance of the torque maximizer 42. For example, in the past the creep level and torque level were evaluated over a sampling period of about 0.5 seconds. The torque maximizer 42 described herein reduces the sampling period to about 20 milliseconds, a 96% reduction. This reduction in sampling period duration vastly reduces the torque maximizer control cycle time. As a result of this decrease in control cycle time, traction performance is improved. Furthermore, torsional vibration and operating noise levels due to wheel/rail squeal are minimized.

The torque maximizer state is computed in a torque maximizer state evaluator block 47 (see FIG. 3) and is a function of the values of DEL_TE, DEL_CRP and the elapsed time since the system has been in the wheelslip/wheelslide control mode (NO_SLP_TIMER).

NO_SLP_TIMER is the timer which keeps track of the time since the adhesion control system was active. This variable is reset to zero whenever a wheelslip or wheelslide is active.

Additionally, the value of the following two conditions are used in the evaluation of the Torque Maximizer State:

1. Condition A is set to a value of TRUE if either of the following conditions are TRUE, otherwise it is set to a value of FALSE.

DEL_TE>0 and DEL_CRP<0

DEL_TE<0 and DEL_CRP>0

2. Condition B is set to a value of TRUE, if the following condition is satisfied, otherwise it has a value of FALSE.

Motor_$crp$_$abs$<=$tm$_$crp$*$abs$(car_speed)

where Motor_crp_abs is the absolute value of the actual creep, tm_crp is the percent allowable creep and abs(car_speed) is the absolute value of the vehicle speed.

The following expressions define the torque maximizer state:

If the system is not in wheelslip or wheelslide control, and the NO_SLP_TIMER has expired, the state of the torque maximizer will be set to modulate the allowable creep level towards the standoff creep limit.

If the system is not in wheelslip or wheelslide control, and the NO_SLP_TIMER has not expired, and both condition A and condition B are both TRUE, then the state of the torque maximizer will be set to decrease the present allowable creep level.

If the system is not in wheelslip or wheelslide control, and the NO_SLP_TIMER has not expired, and both or either condition A and condition B are FALSE, then the state of the torque maximizer will be set to latch the present allowable creep level.

If the system is in wheelslip or wheelslide control, and condition A is TRUE, the torque maximizer state is set to a value that will decrease the allowable creep level.

If the system is in wheelslip or wheelslide control, and condition A is FALSE, and DEL_TE=0 or DEL_CRP=0, the torque maximizer state is set to a value that will latch the allowable creep level.

If the system is in wheelslip or wheelslide control, and condition A is FALSE, and both DEL_TE≠0 and DEL_CRP≠0, the torque maximizer state is set to a value that will increase the allowable creep level.

Limiting functions are provided to insure that the allowable creep speed remains within the region specified by the maximum and minimum allowable creep levels. For example, when the minimum allowable creep level boundary is encountered, the creep mode will be changed from a mode of decreasing the allowable creep level to a creep mode that either increases or latches the allowable creep level. Similarly, the converse will occur if the allowable creep level encounters the maximum allowable creep level.

Further enhancement to the system is possible by controlling the rate of change of allowable creep as a function of the slope of the adhesion—creep curve, i.e. the value of DEL_TE/DEL_CRP.

The torsional vibration detector 44 (FIG. 2) processes the estimated torque feedback and thereby detects the torsional vibration level. In one embodiment the torsional vibration detector 44 obtains a measurement of the torsional vibration level. This measurement is provided to a resonance detector for comparison to a predetermined torsional vibration level resonance cutoff. If this level is exceeded, then there is an excessive level of torsional vibration present in the drive train, and the output RESONANCE_DETECT of the vibration detector is TRUE; otherwise, if the level is not exceeded, then the output RESONANCE_DETECT is FALSE.

Figure 5:
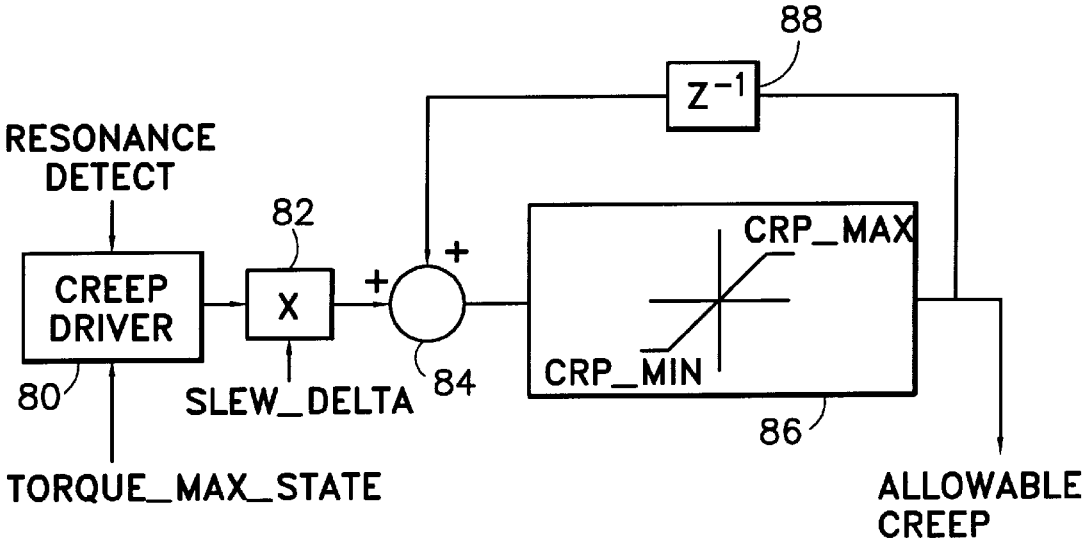
FIG. 5 is a block diagram illustrating one embodiment of a creep modulator useful in the system of FIG. 2.

FIG. 5 illustrates an embodiment of creep modulator 46 (FIG. 2). The function of the creep modulator is to modulate the allowable creep level for each axle between the maximum allowable creep level CRP_MAX and the minimum allowable creep level CRP_MIN. These maximum and minimum allowable creep levels are typically a function of vehicle speed, torque feedback and the state of motor speed sensors. Additional constraints are applied to the allowable creep. These function to allow sufficient creep levels for starting the locomotive from zero speed and to provide a fixed allowable creep level when the axle is functioning as the reference speed mode.

The output from torque maximizer 42 (FIG. 3) TORQUE_MAX_STATE and the output from torsional vibration detector 44 RESONANCE_DETECT are provided to a creep driver 80 which develops a slew rate for modulating the allowable creep level. The slew rate from the creep driver is multiplied in a multiplier 82 by a predetermined nominal slew limit SLEW_DELTA. The product from multiplier 82 is provided to a summer 84 which adds the previous value of allowable creep via creep limit block 86 and $Z^{-1}$ block 88. Block 86 limits the allowable creep to values within the range set by the minimum and maximum limits, CRP_MIN and CRP_MAX. The output of creep limit block 86 is the present value of allowable creep.

The logic associated with the creep modulator is as follows:

(1) The presence of an undesirable level of torsional vibration, as indicated by RESONANCE_DETECT having a TRUE value, takes precedence over all other inputs to the creep driver and forces a reduction at a rate of several times the normal slew limit SLEW_DELTA.

(2) If a tolerable level of torsional vibration exists, as indicated by RESONANCE_DETECT having a FALSE value, operation of the creep modulator 46 is controlled by the output state of the torque maximizer TORQUE_MAX_STATE. When the torque maximizer is in control, the allowable level will be increased or decreased at the normal slew limit SLEW_DELTA.

Advantageously, through the use of the torque maximizer and the method and traction control system described herein, traction performance is maximized while torsional vibration levels are minimized even when operating at maximum adhesion levels on each axle. As a further advantage, the use of the torque maximizer 42 and traction control system 40 described herein, results in a reduction in operating noise levels due to wheel/rail squeal.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A traction control system for use in an electric traction motor propulsion system, comprising:

a torque maximizer for measuring performance level of the traction motor propulsion system and determining a torque maximizer state for maximizing traction performance, wherein the torque maximizer determines performance level from measurements of actual creep derivatives and torque derivatives;

a torsional vibration detector for processing estimated torque feedback for detecting torsional vibration level; and a creep modulator for processing the torque maximizer state and torsional vibration level in order to control operating creep level.

2. The traction control system of claim 1 wherein said torque maximizer includes a first torque filter through which torque signals pass, a second torque filter through which a derivative of consecutive torque signals pass, a first creep filter through which actual creep signals pass, and a second creep filter through which a derivative of consecutive torque signals pass.

3. The traction control system of claim 1 wherein the electric traction motor propulsion system comprises at least two traction motors, each having an axle-wheel set associated therewith, the torque maximizer measuring the performance level and maximizing traction performance of each axle-wheel set, the torsional vibration detector processing the estimated torque feedback for each traction motor, and the creep modulator controlling the operating creep level of each axle-wheel set.

4. The traction control system of claim 1 wherein the torque maximizer has four possible torque maximizer states including (1) decreasing allowable creep level, (2) increasing allowable creep level, (3) maintaining present allowable creep level, and (4) modulating allowable creep level to a stand-off creep limit.

5. The traction control system of claim 3 wherein the torsional vibration detector comprises a digital signal processor for digitally processing the estimated torque feedback for each traction motor to provide a measurement of disturbance in the estimated torque feedback having a frequency component which is substantially the same as the natural frequency of the axle-wheel set associated therewith.

6. The traction control system of claim 5 wherein the torsional vibration detector comprises an n-band bandpass filter.

7. The traction control system of claim 1 wherein the creep modulator comprises logic circuitry for reducing the allowable creep at a rate substantially more than a predetermined normal slew rate whenever the torsional vibration level exceeds a predetermined limit and for adjusting the allowable creep level at the normal slew rate depending on the torque maximizer state whenever the torsional vibration level is less than the predetermined limit.

8. A torque maximizer comprising:

torque feedback filter for filtering a torque feedback signal;

a creep limit evaluator capable of receiving a filtered torque feedback signal for determining maximum, minimum and stand-off creep levels;

a first torque filter for filtering a torque signal;

a torque value derivative evaluator for determining a derivative of consecutive filtered torque values;

a second torque filter for filtering said torque value derivative;

a first creep filter for filtering actual creep level signals;

a creep level derivative evaluator for determining a derivative of consecutive filtered actual creep level values;

a second creep filter for filtering said actual creep level derivative; and a torque maximizer state evaluator for determining a torque maximizer state based on the values of the actual creep level derivative and the torque value derivative.

9. A method for controlling traction in an electric traction motor propulsion system, comprising:

measuring a performance level of the traction motor propulsion system and determining a torque maximizer state for maximizing traction performance from measurements of actual creep derivatives and torque derivatives;

detecting a torsional vibration level based on estimated torque feedback; and developing a slew rate based on the torque maximizer state and the level of torsional vibration in order to control operating creep level.

10. The method of claim 9 including the steps of:

passing a torque signal through a first torque filter;

passing a derivative of consecutive torque signals through a second torque filter;

passing an actual creep signal through a first creep filter;

passing a derivative of consecutive creep signals through a second creep filter.

11. The method of claim 9 wherein the electric traction motor propulsion system comprises at least two traction motors, each having an axle-wheel set associated therewith, the steps of measuring, detecting and controlling being performed separately for each axle-wheel set.

12. The method of claim 9 wherein there are four possible torque maximizer states including (1) decreasing allowable creep level, (2) increasing allowable creep level, (3) maintaining present allowable creep level, and (4) modulating allowable creep level to a stand-off creep limit.

13. The method of claim 12 wherein the step of detecting torsional vibration level comprises digitally processing the estimated torque feedback for each traction motor to provide a measurement of disturbance in the estimated torque feedback having a frequency component which is the same as the natural frequency of the axle-wheel set associated therewith.

14. The method of claim 13 wherein the step of detecting comprises an n-band bandpass filtering process.

15. The method of claim 9 wherein the step of processing the torque maximizer state and the torsional vibration level in order to control operating creep level comprises reducing the allowable creep level at a rate substantially more than a predetermined normal slew rate whenever the torsional vibration level exceeds a predetermined limit and for adjusting the allowable creep level at the normal slew rate depending on the torque maximizer state whenever the torsional vibration level is less than the predetermined limit.

16. A method of torque maximization comprising of:

filtering a torque feedback signal;

receiving a filtered torque feedback signal;

determining maximum, minimum and stand-off creep levels;

filtering a torque signal;

determining a derivative of consecutive filtered torque values;

filtering said torque value derivative;

filtering actual creep level signals through a first creep signal;

determining a derivative of consecutive filtered actual creep level values;

filtering said actual creep level derivative through a second creep filter; and determining a torque maximization state based on the values of the actual creep level derivative and the torque value derivative.

* * * * *